United States Patent [19]

Rosenfield et al.

[11] Patent Number: 4,800,005

[45] Date of Patent: Jan. 24, 1989

[54] TREATMENT PLANT FOR RECOVERY OF METAL FROM HAZARDOUS WASTE

[76] Inventors: Gerson J. Rosenfield, 40 Edgelawn Ave., North Andover, Mass. 01845; Samuel Rosenfeld, deceased, late of Lexington,, Mass.; Rhoda Rosenfield, executrix, 6 Wheeler Rd., Lexington, Mass. 02173

[21] Appl. No.: 85,366

[22] Filed: Aug. 14, 1987

[51] Int. Cl.[4] ..... C25C 1/20; C02F 1/46; C25D 17/00; C25D 17/12

[52] U.S. Cl. ..... 204/109; 204/149; 204/212; 204/228; 204/269

[58] Field of Search ..... 204/109, 232–233, 204/212, 275–278, 269, DIG. 13, 149–150, 228, 293

[56] References Cited

U.S. PATENT DOCUMENTS

| | | | |
|---|---|---|---|
| 3,637,473 | 1/1972 | Greenspan et al. | 204/232 X |
| 3,705,716 | 12/1972 | Hendrickson | 204/109 X |
| 3,715,291 | 2/1973 | Bentley | 204/212 X |
| 3,964,990 | 6/1976 | Woyden | 204/228 X |
| 4,257,864 | 3/1981 | Gacki | 204/213 |
| 4,652,352 | 3/1987 | Saieva | 204/149 X |

FOREIGN PATENT DOCUMENTS

| | | | |
|---|---|---|---|
| 2741080 | 3/1979 | Fed. Rep. of Germany | 204/109 |

*Primary Examiner*—Donald R. Valentine
*Attorney, Agent, or Firm*—Herbert L. Gatewood

[57] ABSTRACT

A treatment plant for the recovery of silver from spent photo fix solution is provided in which the concentration of silver in the spent solution is reduced to meet Environmental Protection Agency standards in two sequential stages. In the first stage, silver is recovered electrolytically by plating out on vertically disposed, rotating cathodes as the spent solution flows from one electrode chamber to another arranged in serial fashion in the electrolytic unit assembly. The silver concentration is then further reduced by passing the overflow from the electrolytic unit upwardly through a column of shredded steel wool or ion exchange resin.

35 Claims, 3 Drawing Sheets

TREATMENT PLANT FOR RECOVERY OF METAL FROM HAZARDOUS WASTE

BACKGROUND OF THE INVENTION

1. Field of Invention

This invention relates, in general, to a treatment plant for the recovery of metal from hazardous waste. More particularly, the invention relates to a sequential process for recovery of precious metal from a waste solution in two stages involving first the electrolytic recovery of the greater portion of the metal from the hazardous waste material, followed by further recovery of metal in the second stage by means of ion exchange or shredded steel wool, and apparatus suitable for use in that two stage process. Still more specifically, the invention relates to a process and apparatus for recovering silver metal from spent photographic fix solution, first electrolytically, followed by further recovery using ion exchange or shredded steel wool.

2. Description of the Prior Art

Black and white photographic film is a highly light-sensitive photographic material which is sold commercially in the form of roll films, plates or photographic papers. It is used for black and white photography.

This film, in general, comprises a light-sensitive emulsion layer on a substrate such as a layer of cellulose acetate. The emulsion comprises silver bromide crystals in a binder of gelatin as the main components; however, the silver bromide emulsion is not equally sensitive to all colors of light. For this reason the coating is chemically sensitised by the addition of minute quantities of gold, mercury, and other heavy metal ions to the silver bromide and by feeble reaction with sulphide ions. Also, the coating is physically sensitised by the addition of pigmental sensitisers and thus made sensitive to a wider range of hues.

The photographic image is formed by the light rays which come from the subject being photographed and are focused on the light-sensitive coating of the film by the lens system of the camera. Each ray of light that strikes the film encounters silver bromide crystals, which are thereby activated. The exposed film is then developed in a development bath, which is a solution of a chemical reducing agent (developer). The latter reduces the activated silver bromide particles to black metallic silver. Silver bromide which has not been activated by exposure to light is not reduced by the developer and can be dissolved out of the emulsion coating by immersion of the developed film in a so-called "fixing bath", which contains ammonium thiosulate or sodium thiosulfate ("hypo"), sometimes incorrectly called "sodium hyposulfite", that dissolves unexposed silver bromide.

After the developer and fixing solutions have been washed out of the film and the latter has dried, the result obtained is the negative. On a negative the shadows appear as "white" (transparent) areas, while the highlights appear black. If the negative is then placed in contact with photographic paper (positive paper) and exposed to light, then the areas of this paper under the (dark) highlights in the negative will receive little light, while the areas under the (white) shadows in the negative will be strongly exposed. On developing this photographic paper, a "print" is obtained in which the exposed areas come out dark, while the unexposed areas remain white, and of course those areas which are somewhere between deep shadow and bright highlight come out in various intermediate shades of grey. The dark and light areas of the negative are thus reversed in the printinq process.

It is well known that the effectiveness of a hypo solution is reduced as the silver content thereof is increased. Thus, it is common practice to recover the silver in expended "hypo" photographic fixing ("photo fix") solutions by one of three prevalently used methods: (1) chemical precipitation, (2) metallic replacement (ion displacement), or (3) electrolytic plating. The latter method, in general, consists of flowing a direct electric current through the spent "hypo (or photo fix)" solution, between electrodes which causes the silver to be deposited in a plate form on the negative electrode (the "cathode").

The electrolytic plating method is generally conceded to be the most desirable of the three methods, since if the current densities are controlled and adjusted to conform to the varying concentrations of silver in the spent "photo fix" solution, the efficiency of silver recovery can be greater than with the other methods, and, when the concentration of silver in the spent "photo fix" solution has been lowered substantially, permits the recycling and re-use of the solution, if desired, thereby permitting considerable monetary savings in the purchase of photographic chemical solutions.

The chemistry of the electrolytic separation is somewhat complex. It is believed that the deposition of silver at the cathode is a secondary reaction. The hypo salts yield sodium or ammonium cations and thiosulfate anions. The thiosulfate ions which are negatively charged migrate towards the anode and upon reaching the anode are oxidized and the free silver ions remain in the solution. At the cathode, the sodium cations are discharged as sodium atoms and are so reactive that they decompose any ions which exist in the vincinity of the cathodes. If any thiosulfate ions are present, silver is deposited on the cathode plate (negative electrode). If not, highly reactive sodium ions reduce the hypo to a series of compounds, most of them fatal to the hypo solution. One of the compounds which is generally present when an insufficient amount of thiosulfate ions are present in the vicinity of the cathode is silver sulfide. The silver sulfide is dark brown in color and shortens the life of the hypo solution. Thus, in order to avoid the formation of silver sulfide in the solution, an adequate supply of thiosulfate ions in the vicinity of the cathode is believed a necessity. Nevertheless, this is a particular problem. Thiosulfate ions are not necessarily uniformly dispersed throughout the spent solution, particularly in a stagnant solution. And, as the thiosulfate ions are located in the solution at different distances remote from the anode, the migration toward the anode varies somewhat. Moreover, the concentration of silver ions in the photo fix solution is constantly changing with progression of the electroplating of silver from the solution. And, this concentration is not uniform throughout the solution, particularly in the vicinity of the cathode when silver has just been plated out of solution.

Furthermore, as the silver concentration is reduced in the solution, as a result of silver being plated out on the cathode, the power requirement across the electrodes changes. Thus, this power requirement must be related to the concentration of the silver in solution. If too much power (hence current too great) is applied to the electrodes with respect to the amount of silver available in the solution, a chemical reaction occurs within the solution which produces a sulfide gas (a process which is sometimes referred to as "sulfiding"). The generation of sulfide gas creates a very strong order in the environment and, if permitted to continue, will cause the silver plated out to burn and flake, permitting flakes of silver sulfide to wash away with the wash solution. On the other hand, if the voltage applied to the recovery system is too small (and therefore insufficient current) with respect to the quantity of silver in the solution, then silver in the spent photo fix solution may not be recovered in the time permitted for recovery. As a result, not only will dissolved silver be lost in the waste but, most importantly, as hereinafter more fully disclosed, the waste may contain environmentally unacceptable levels of silver. Thus, it is desired to operate at voltages whereby to recover from the spent photo fix solution the maximum amount of silver in the shortest period of time possible, and without sulfiding, but also to reduce the silver concentration to environmentally acceptable levels.

Over the years various and numerous devices have been invented to accomplish the recovery of silver from photo fix solution, and more efficiently, to better control the current densities during the electroplating operation, and to permit more rapid and uniform plating of silver from the photo fix solution. None of the systems, however, with which I am acquainted are entirely successful. Exemplary of this prior art are U.S. Pat. Nos. 2,791,555; 3,551,318; 3,560,366; 3 715 291; 3,964,990; 4,257,864; 4,305,805; and 4,652,352.

U.S. Pat. No. 2,791,555 discloses a method and apparatus for rejuvenating and prolonging the life of hypo solutions. The apparatus therein disclosed comprises a cathode element comprising a plurality of horizontally disposed circular shaped plates, in spaced-apart location on a vertically disposed, rotable shaft. On each side of the cathode element in diametric opposition to one another are located vertically disposed anode plates, connected together at their top by a conductive strip. The patentee discloses that such a rotatable cathode causes a shearing action in the hypo solution, resulting in there always being available at the surface of the cathode plates a sufficient amount of thiosulfate ions to permit appropriate plating of the silver without formation of silver sulfide. Nevertheless, the cathode plates in the invention disclosed in U.S. Pat. No. 2,791,555 are horizontally disposed while the anode plates, rather than being in a face-to-face relationship therewith, are located perpendicular to the cathode plates, in vertical disposition.

U.S. Pat. No. 3,551,318 discloses apparatus like that in the previously mentioned patent, i.e., U.S. Pat. No. 2,791,555. Nevertheless, the patentee discloses a system in combination therewith whereby the plating current is turned off gradually as a critical silver concentration is approached in the spent photo fix solution. Thus, plating is not allowed to occur beyond a critical concentration level of silver in the solution, thereby avoiding, according to the patentees, any undesirable side reactions due as a result of excessive power supplied to the electrodes. Like the anode and cathode plates in U.S. Pat. No. 2,791,555, the electrodes disclosed in this patent are oriented perpendicular with respect to one another resulting in somewhat less efficient power requirements than if the electrode plates were arranged face-to-face. Moreover, it has been determined that with horizontally disposed circular-shaped rotating cathodes such are not plated uniformly across their surface, a heavy concentration of silver plates at the outer periphery.

U.S. Pat. No. 3,560,366 discloses a uniquely designed vertically disposed cathode in the form of a cylinder or polyhedron mounted for rotation about a vertical axis. The anode comprises four vertically disposed cylindrical-shaped members in close proximity of the cathode. Thus, according to the patentee, a controlled interchange of the photo fix solution across the cathode surface is obtained.

U.S. Pat. No. 3,715,291 discloses silver recovery means for photo fix solutions wherein there is provided, in combination with the electrolytic silver recovery unit, an auxiliary tank upstream thereof to receive the silver waste solution from film processing equipment or other sources. A metering pump delivers the waste solution from the auxiliary tank to the silver recovery unit, the pump being started and stopped in dependence upon changes in the level of the waste solution in the auxiliary tank. The silver recovery unit operates only when the metering pump is running. Thus, according to the patentee, as a constant flow of solution enters the electrolytic unit, and at a constant silver concentration, this enables the silver recovery unit to be operated at a constant current setting selected appropriate to the particular silver concentration in the spent photo fix solution in the auxiliary tank. That being the case, according to the patentee, the problems associated with varying silver concentrations and a more or less arbitrarily selected current value disappear. Nevertheless, one problem with a spent photo fix solution is its excessive corrosiveness. As a result, such a solution would readily attack, it is believed, the sealed joints where the suction pipe connects the holdup tank to the pump and the sealed joints whereby the delivery pipe connects the pump to the holdup tank and to the silver recovery unit. Thus, the maintenance connected with such apparatus and the continual replacement of seals makes for not only somewhat unsatisfactory operation but added costs as well.

U.S. Pat. No. 3,964,990, like U.S. Pat. No. 3,715,291, discloses a holding tank for spent photo fix solution in combination with an electrolytic unit. The spent solution, according to this invention, however, is pumped into the recovery unit intermittently in dependence upon the concentration of silver in solution in the recovery unit. The system operates with a substantially constant voltage across the electrode plate in the recovery unit, with the concentration of the solution in the recovery unit being maintained substantially constant by the intermttent operation of the pump submerged in the holdup tank. The anodes and cathodes are located in spaced apart position, in horizontal disposition, on a vertically disposed rotable shaft, and are of octagonal shape. Round plates, however, according to the patentee are not desired in a system of this type, since when a round cathode is used, silver tends to build up on the outer edge of the plate, interfering with the circulation of liquid around the plate and applying substantial forces to the interior plate-supporting structure. Nevertheless, with such an arrangement as disclosed, the corrosive nature of the spent solution presents problems to the operation of the submerged pump and the operation of the float valves.

U.S. Pat. No. 4,257,864 discloses a portable unit for recovering silver from photographic processing solutions which includes a cathode assembly supported for rotation about a horizontally disposed axis. A plurality of circular-shaped spaced-apart, plate-like thin discs are located along the shaft and define cathode elements on which silver is plated. These cathode plates and shaft are located within an an apertured, cylindrical-shaped barrel and rotate in combination therewith. Spaced apart, elongate, stationary anodes are located in parallel relation to one another and in the recovery unit below the rotatable cathode assembly. Thus, the electrode arrangement results in greater power requirements and less efficient overall operation and cost.

U.S. Pat. No. 4,305,805 discloses the combination of a silver recovery apparatus, a silver solution source, and a holding tank. The solution accumulates in the holding tank to a given quantity. When there is sufficient silver solution in the holding tank, the solution is then caused to flow to the silver recovery apparatus through a flow metering valve, and the silver recovery apparatus then operates to recover the silver. The holding tank disclosed, however, suffers from the problem that spent photo fix solution is discharged from near the bottom thereof. As a result, the corrosive nature of the solution attacks the seals at the outlet opening and those of the valves provided in the conduit connecting the holding tank with the silver recovery unit.

U.S. Pat. No. 4,652,352 discloses recovering metals from dilute solution utilizing ion exchange and, optionally, electrolytic recovery. Thus, according to the patentee metals may be recovered from spent electroplating rinse solution for reuse in the electroplating both with essentially no generation of waste.

Of particular concern, as above-mentioned, with apparatus used in the recovery of silver from spent photo fix solutions is the corrosive nature of such solutions. In relatively short time bearings and the like exposed to such solutions become corroded and need be replaced. Seals degenerate, resulting in leakage, and needed replacement. Both add to the cost of such recovery operations not only because of the cost of replacement of equipment and parts, but also in down time and need for maintenance personnel. Moreover, because of the corrosive nature of these solutions it has not been found possible to entirely prevent leakage of the solution through bearings and fittings in contact therewith. As a result, the spent photo fix solution often leaks out of holding tanks and electrolytic units now being used, into the adjacent work area, creating not only a messy area and a housekeeping problem, but an unsafe condition, in the event that an employee's skin comes into contact with such leaked solution.

Although there has been concern, particularly over the past several years, about the disposal of hazardous waste-materials, the regulations of the Environmental Protection Agency (EPA) have exempted, until somewhat recently, precious metal wastes. Nevertheless, such waste material has been subject to local air and sewage discharge regulations. As a result of these local regulations, it has become somewhat common practice for many of the smaller photographic film developers, in particular, to collect such "hypo" or "photo fix" waste materials and to have that waste, before disposal, treated by independent contractors. Thus, it has been common practice for some years now for "recycling companies" to pick up the photographic fix waste material from photofinishers, printers, hospitals, and other developers of photographic film and x-rays, etc. and to recover the silver from that waste material, making the photo fix solution suitable for disposal or, in some cases, reusable by the film developer.

Now, however, with new regulations established by the EPA, and beginning in 1986 precious metal hazardous waste materials are no longer exempt from its regulation. Moreover, the EPA has set the standards by which the local water districts must comply. In the case of silver dissolved in photo fix solutions that requirement is now less than 5.0 ppm. Thus, the developers of all photographic film, x-rays, etc., and the independent contractors recovering silver from spent photo fix solutions, or those involved in recycling the solution, must comply with these new standards. Nevertheless, with such waste material no longer being exempt from the EPA regulations, and with other increased costs of operation in meeting not only the EPA but also local waste discharge requirements, it may no longer be economically feasible for these independent contractors and recycling companies to continue in operation, and to perform the services for the photographic and x-ray film developers that have been performed in the past. That being the case, it may be that each such a film developer will have to perform its own silver recovery operation on the photo fix waste, in order to be able to dispose of the waste material, or to reduce the silver concentration therein so that it can be reused. Of concern, however, even to the photographic and x-ray film developers, particularly those more localized and having relatively small operations, is the cost of an electrolytic recovery unit that will reduce the silver content in the spent photo fix waste material to meet the EPA standards, whereby such waste material can be discharged to waste streams, or otherwise disposed of. To my knowledge, there is now no commercially available unit for less than about $15,000.00 that will provide adequate recovery of silver from the photo fix waste material, and reduce the silver concentrations in that material to the extent required by the EPA.

SUMMARY OF THE INVENTION

It is an object of this invention to provide a treatment plant for the recovery of silver from spent photo fix solutions that meets the standard for such waste material established by the EPA.

It is also an object to provide a treatment plant for the recovery of silver from spent photo fix solutions wherein the concentration of silver in the spent solution is reduced to less than 5.0 ppm.

It is a further object of the invention to provide a treatment plant which can reduce the concentration of silver in spent photo fix solution, to less than 5.0 ppm and which can, if desired, be connected directly to the photographic processing operation making a hazardous waste permit from the EPA unnecessary.

It is a further object to provide a treatment plant for the recovery of silver from spent photo fix solutions, in a two-stage recovery process, wherein the silver concentration in the spent solution can be reduced in the first stage electrolytically from as much as 7,000 ppm to less than 50 ppm and then, in the second stage, by passing the already reduced concentration solution through a column of shredded steel wool or ion exchange resin the concentration of silver in the photo fix solution is further reduced to less than about 5.0 ppm.

It is a further object of the invention to provide a treatment plant for the recovery of silver from spent photo fix solution wherein a sealed holding tank for the spent solution is provided which has no openings therein below the level of the spent solution contained within the tank, the inlet and outlet openings being entirely provided in the tank's top surface whereby to better avoid the problems caused by the corrosive spent photo fix solution.

It is a further object of the invention to provide a treatment plant for the recovery of silver from spent photo fix solutions that is relatively simple in construction whereby it is not only economical in cost, but also in operation.

It is a still further object of the invention to provide an improved electrolytic recovery unit for silver from spent photo fix solutions wherein the cathode assembly comprises circular-shaped cathode plates, and such plates are not found to result in build-up at the outer edges thereof, as has been the case heretofore with use of circular-shaped cathode plates.

It is a still further object of the invention to provide an improved electrolytic recovery unit for silver from spent photo fix solutions comprising a cathode assembly comprising circular-shaped cathode plates wherein silver is found to plate out of solution more uniformly on the surface of the circular-shaped cathode plates than with use of such cathode plates known heretofore.

It is still a further object of the invention to provide an improved electrolytic silver recovery unit which is of unique construction thereby offering efficiencies in silver recovery from spent photo fix solutions.

It is still an additional object of the invention to provide a treatment plant for the recovery of silver from spent photo fix solution wherein the electrolytic recovery unit comprises a housing sealed at levels below that of the solution treated so as to avoid leakage of the solution thereby reducing the possible adverse effects of the corrosive nature of the solutions being handled.

A unique feature of the invention is that the electrolytic recovery unit comprises an electrode assembly comprising a plurality of anode plates and cathode plates that are not only vertically disposed but located alternately in spaced-apart manner along a rotable shaft, the cathode plates being rotable and the anode plates being stationary.

A further unique feature is that the cathode assembly defined by the plurality of cathode plates, rotable shaft and end plates supporting the shaft is readily removed from the electrode assembly and from the silver recovery unit, providing relative ease in the removal of silver from the cathode plates.

A still further unique feature of the electrolytic recovery unit according to the invention is that it is defined by a plurality of separate and distinct chambers arranged sequentially one after the other in which recovery of silver is attained electrolytically.

A still further unique feature of the invention is that in the electrolytic unit of the invention the spent hypo solution is treated incrementally and silver is recovered in a series of stages from the spent solution as it passes through the electrolytic recovery unit.

BRIEF DESCRIPTION OF THE DRAWING

The novel features and operation of the precious metal treatment plant of the invention will be better understood by reference to the drawing, in conjunction with reading the following specification, in which.

DETAILED DESCRIPTION OF THE DRAWING AND THE PREFERRED EMBODIMENT

Figure 1:
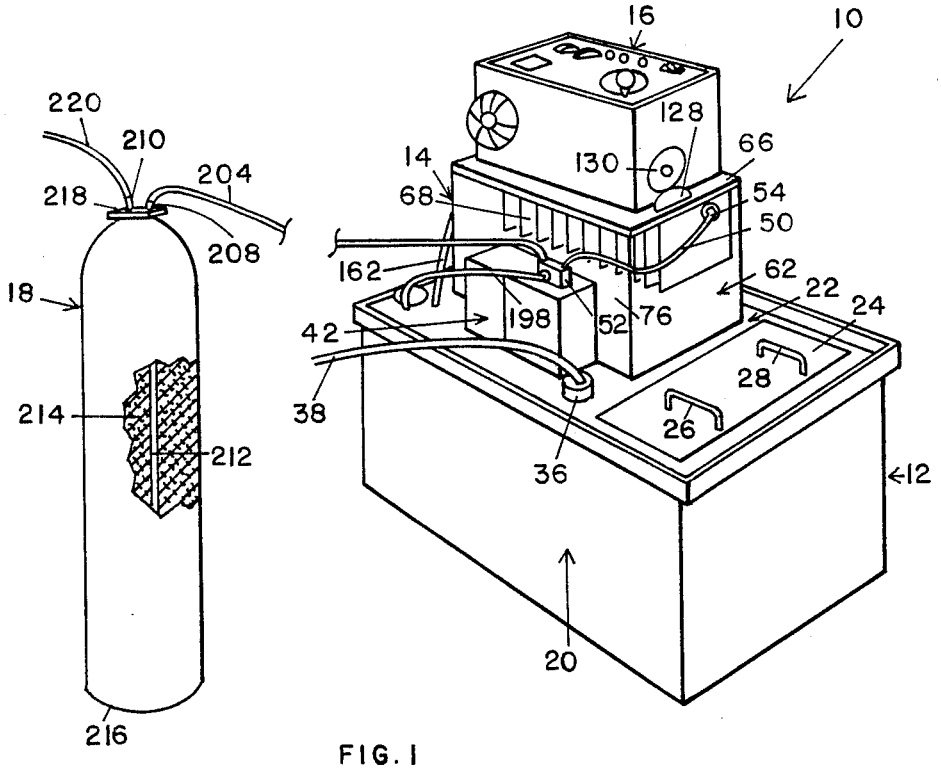
FIG. 1 is a perspective view of the treatment plant according to the invention.

Turning now to the drawing there is disclosed in FIG. 1 thereof a treatment plant 10, in accordance with the invention, for the recovery of silver metal from a spent photographic fix solution. Treatment plant 10 comprises, in combination, a holding tank 12, an electrolytic recovery unit 14, an electronic console 16, and column 18 which comprises a second stage recovery unit for silver from the spent solution.

Holding tank 12, as shown in the drawing, is of rectangular shape, having a bottom portion 20 for the holding of the spent photo fix solution and a top closure 22, which may be removably fastened to the bottom portion 20 according to conventional techniques.

In top closure 22, there is provided an opening (not shown) which is covered by door 24 through which spent electrolytic solution can be introduced when treatment plant 10 is operated for batch processing. Door 24 is provided with handles 26, 28 for aid in removing the door. The door 24 can be completely removable from the opening or hinged in some suitable manner, as desired, and as conventionally provided.

Figure 2:
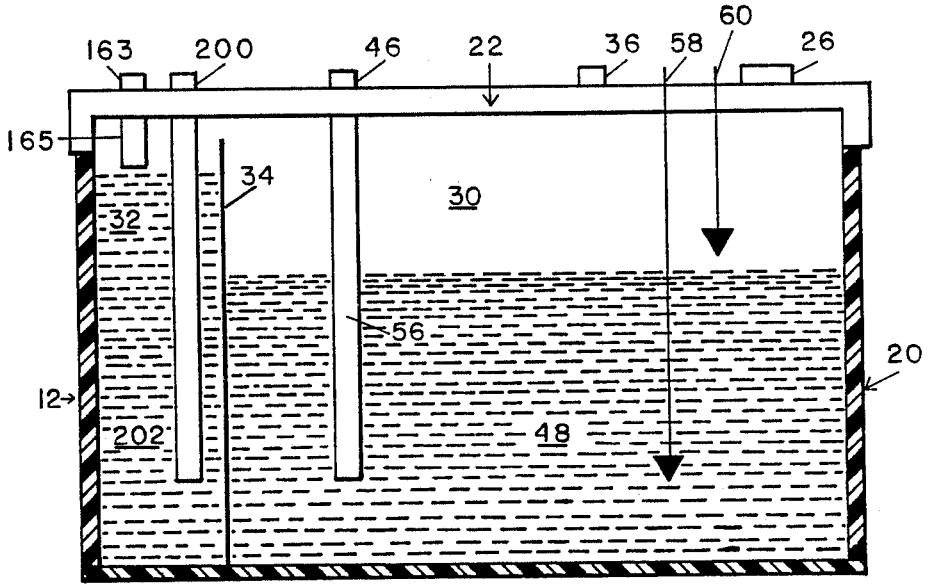
FIG. 2 is a sectional view of the holding tank shown in FIG. 1, with the nearest side wall removed.

Bottom portion 20 of holding tank 12, as will be seen by reference to FIG. 2 of the drawing, is divided into two separate and distinct compartments 30,32, by dividing wall 34, the reason for which will soon be made clear.

An inlet opening 36 is provided in top closure 22 for introduction of spent photo fix solution into holding tank 12, when treatment plant 10 is connected directly to the photo fix solution overflow of, for example, a photographic film developer (not shown). In this case, the film developer will be connected to holding tank 12 by means of conduit 38 which, in turn, will be connected to the discharge outlet of a tank overflow (not shown). The spent photo fix solution will flow from the overflow, none of which is a part of this invention, through conduit 38 into the holding tank outlet. Conduit 38 can be provided, if desired, with a conventional threaded coupling for connection to inlet opening 36.

It will be appreciated however, that the particular shape of holding tank 12 is of no consequence to the invention. It can be of a square-shape, or round, if desired, rather than of rectangular shape. Also, the holding tank need not be divided into two compartments. Two separate tanks can be provided, instead, to accomplish the purposes disclosed herein. The double compartment tank, however, is most preferred, as it offers economies in space considerations and, ease in operation. Holding tank 12 can be provided with an overflow outlet connected to a further holding tank, if desired. Nevertheless, such an outlet should be provided at the upper portion of the holding tank, closely adjacent to top closure 22. A unique feature of holding tank 12 is that there are no openings therein below the top closure 22 hereby to avoid any possible leakage from holding tank 12 into the surrounding work area where the treatment plant 10 is located. Holding tank 12 can be of various materials, e.g., polyethylene. The main consideration is that it be resistant to the corrosiveness of the spent photo fix solution and that it can be constructed to provide a sealed bottom portion.

Sitting on the top side of top closure 22, as shown in FIG. 1 is a double-headed metering pump 42, the inlet port 44 of which is hidden but is connected to opening 46 which communicates with compartment 30 in the holding tank 12 for withdrawal of spent photo fix solution 48 therefrom and metering such solution to the electrolytic recovery unit 14 via conduit 50. Conduit 50 can be of Tygon or other PVC tubing and is connected at one end to the multihead fitting 52 of metering pump 42 and at the other end to a conventional fitting 54 which communicates with the electrolytic recovery unit 14, as later more fully disclosed. As will be seen by reference to FIG. 2, a vertically disposed conduit 56 connects with opening 46 and extends downwardly into compartment 30, the lower end of which is below the lowest desired level of spent photo fix solution 48 in holding tank 12. Conduit 56 can be of various materials so long as such is resistant to the corrosive solution involved. A Lexan polycarbamate pipe is preferred as such will not only be corrosion resistant but also resist cracking in use, but other materials may also be used. Those in the art will readily appreciate that some suitable amount of photo fix solution 48 should always be left in holding tank 12 so that, between treatment cycles, the liquid in the photo fix solution will not completely evaporate. Where complete evaporation is allowed to occur, crystallization will take place, presenting difficulty when it is next desired to operate the treatment plant. The desired amount of solution to be left in holding tank 12 will depend on a number of factors, e.g. time span between operations, i.e., how long the solution is exposed to evaporation, the seal that closure 22 provides with bottom portion 20, openings in closure 22 that may not be actually provided with sealed fittings and connections, etc. Toward that end, i.e., the maintaining of a certain level of spent solution in holding tank 12, there are provided in compartment 30, liquid level switches 58, 60 for providing that metering pump 42 is activated at some predetermined, desired maximum level in the holding tank 12 whereby spent photo fix 48 is metered to the electrolytic unit 14, and that the metering pump is deactivated when that amount of photo fix solution has been extracted from the holding tank that the desired minimum level of solution is reached in the holding tank. The system is wired in accordance with conventional technique, such that when the metering pump 42 is activated the remaining system units are activated, and when metering pump 42 is deactivated, the other system units are deactivated, all as hereinafter more fully described. The wiring circuitry to accomplish this is believed within the skill of the art and need not be further disclosed herein.

In the practice of the invention, compartment 30 in the holding tank 12 has a 15 gallon capacity, and the smaller compartment 32 has a capacity of 2 gallons. However, it will be appreciated that holding tanks of various capacity can be used in the practice of the invention. The size thereof, as with that of the other components of the treatment plant of the invention will depend somewhat upon the amount of spent photo fix solution that must be processed on a regular basis. The capacity of holding tank 12 disclosed herein, and that of the other components of the treatment plant disclosed herein will be entirely adequate for use by relatively small photofinishing operators, e.g., to process 12 gallons per day of spent photo fix solution, if necessary. The liquid level switches 58, 60 used in the practice of the invention, can be set to activate the metering pump when any desired maximum level, e.g., 12 gallons of spent solution in holding tank 12 is attained, and to deactivate metering pump 42 when the desired minimum level is reached, e.g., 5 gallons.

Various liquid level switches will be found satisfactory to accomplish the purposes set forth herein. In the practice of this invention, NNR 110 Liquid Level Switches available from Syrelec Corporation of Dallas, Tex. have been used. Also, it will be appreciated that various multihead pumps will be found suitable, the one being used in the practice of this invention being a self-priming, bellows-type, adjustable flow pump commercially available from Gorman-Ruff of Bellville, Ohio. Thus, the spent solution is prevented from corroding any pump seals with attendant leakage. Nevertheless, any pump providing a pulsating flow will be found suitable provided it is capable of adjustable flow and can deliver the flow rate desired. This, of course, will depend somewhat upon the capacity of the electrolytic recovery unit 14. A bellows-type pump is desired, however, because of the corrosiveness of the solution being handled, to avoid leakage and added maintenance. As will be appreciated by those skilled in this art, pulsating flow plumps are desired, as such a break in the continuous flow of spent solution will help prevent electrical conductivity back to the pump and holding tank thereby avoiding plating out of silver on these components. Most importantly, however, whatever pump chosen must have the ability to draw-up spent solution 48 vertically in conduit 56 from compartment 30 to the pump inlet port connected to opening 46.

The electrolytic recovery unit 14, as will be more readily appreciated by reference to FIGS. 1, and 3–5 comprises a housing or receptacle 62 having a box-like, bottom portion 64 and a detachable top cover 66, and an electrode assembly located within the bottom portion 64 of the housing denoted generally by reference number 68. Bottom portion 64 of the housing is defined by vertically disposed, planar, first and second end walls 70, 72, parallel to one another, and vertically disposed, planar, first and second side walls 74, 76, parallel to one another, all of which are supported by bottom closure 78. The end and side walls intersect as is shown in the drawings, and with bottom closure 78 form a sealed, box-like cavity for containment of the electrode assembly 68 and spent photo fix solution (not shown in the electrolytic unit assembly for sake of clarity) being electrolytically treated. Bottom portion 64 is provided with an inlet opening 80, in end wall 70, in which is located inlet fitting 54 near the top edge 82 of end wall 70. Thus, spent photo fix solution can be introduced into the electrolytic unit 14. At the other end of the housing, in end wall 72, there is provided an overflow opening 84 which communicates with conventional threaded fitting 86, like that in the inlet end. Nevertheless, it may be found desirable to provide fitting 86 of somewhat larger size than fitting 54 to keep the rate of overflow from the housing relatively the same as that flow into the housing due to any back pressure created against the flow by the electrode assembly 68. Fitting 86, like fitting 54, is provided with a thread pattern which matches a thread pattern provided in the end wall opening, neither thread pattern being shown, however, for sake of clarity.

Figure 3:
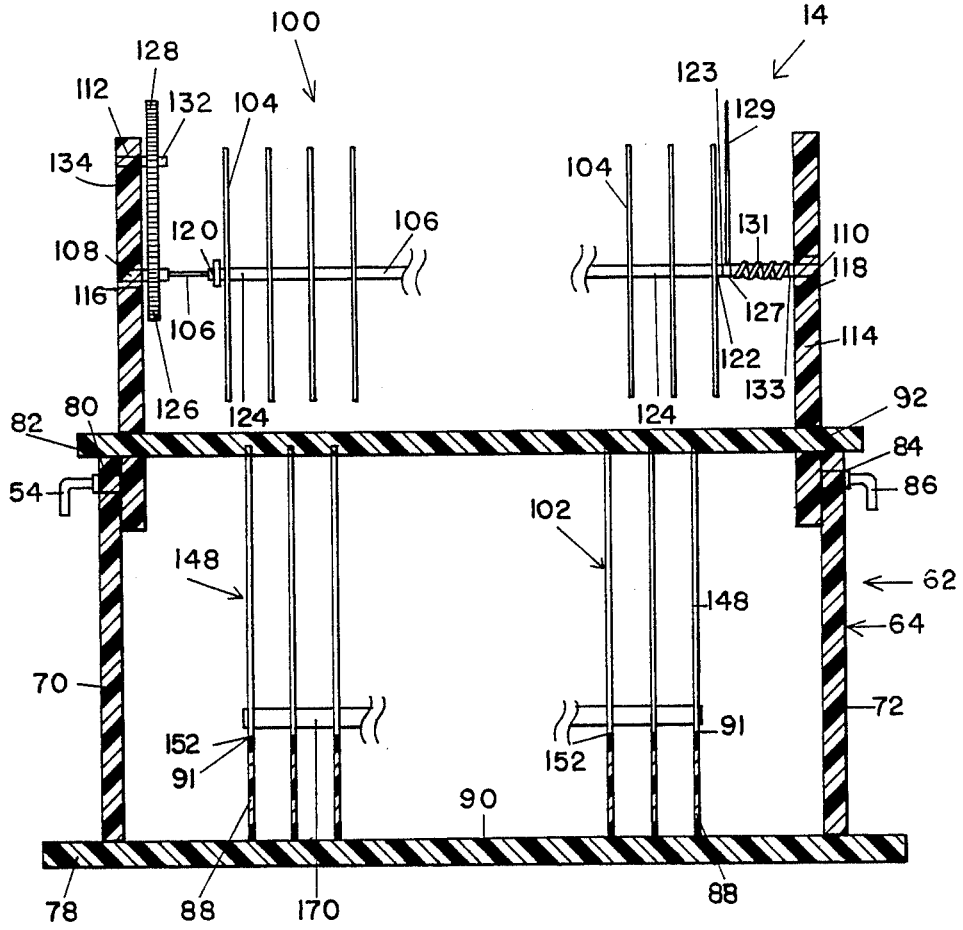
FIG. 3 is a side view of the electrolytic recovery unit according to the invention, as shown in FIG. 1, but turned so that the observer is looking at the backside of the recovery unit shown and showing the cathode assembly being dissassembled from the anode plates and removed from the housing for the electrolytic recovery unit, the front side wall in the housing having been removed.

By referring to FIG. 3, it will be seen that a plurality of upright, vertically disposed, planar members 88 are provided within housing 62, these members being supported by, and integral with, the upper surface 90 of bottom closure 78. Planar members 88 are uniformly spaced apart from one another, and the outermost members extend equal distances inwardly a suitable distance, e.g. 2½ inches, from respective end walls 70, 72. This distance, however, is not critical and can be more or less, as desired.

Nevertheless, a distance of 2½ inches will be found practical, to provide access into these end areas. Members 88 extend vertically upwardly a predetermined distance, as will be later disclosed more fully, if not already appreciated from the drawings, and the top edges 91 thereof terminate in the same horizontal plane. These members extend laterally across the bottom portion and terminate in sealing engagement with the inside surfaces of side walls 74, 76. If desired, vertically disposed channels can be provided in the side walls for the ends of members 88 to intrude.

As earlier disclosed, the top cover 66 is detachably connected to the housing bottom portion 64. This can be readily accomplished by conventional threaded screw means (not shown) which extend vertically downwardly through openings (not shown) provided in top cover 66 into threaded dead bores, generally denoted by reference numeral 94, located in respective locations in the top edges 82, 92 of flange members on the end walls 70, 72, respectively, and in the top edges 96, 98, respectively, of the flange members on side walls 74, 76. Thus, with top cover 66 in place, a self-contained housing 62 is provided for electrode assembly 68, having no openings below the maximum level of the corrosive solution being treated, thereby containing that solution so that no seepage of the corrosive photo fix solution from the electrolytic unit can occur into the operating environment. Housing 62 used in the practice of the invention has a capacity of 2 gallons; however, as earlier disclosed this housing can be larger, if desired. Nevertheless, the capacity of the housing disclosed is believed to be a practical minimum capacity for most relatively small silver recovery operations. A smaller capacity housing (or "treatment tank" for the spent solution) would, of course, provide a smaller amount of spent solution from which silver could be recovered. And such would necessitate more frequent shut-down and disassembly as hereinafter more fully disclosed, and recovery of the plated-out silver from the unit. The inside dimensions of the housing 62 used in the practice of the invention are 6 inches wide×14 inches long×8 inches high. The housing was constructed of commercially available ¼ inch thick plates of an acrylic plastic material found to be highly resistant to the corrosive solution processed therein. Nevertheless, any material can be used for construction of the housing provided such material is non-conductive and can withstand the corrosive properties of the spent photo fix solution being treated. The material used should be capable of being joined together, e.g., where end and side walls meet so that no leakage of the solution can occur. Moreover, and this is a preferred aspect of this invention, whatever the plastic material used, it should preferably be clear, thereby permitting the operator to observe the progress of the recovery of silver from the photo fix solution. The mating surfaces of the end and side walls, in the case of the acylate plastic used, can be welded together using conventional solvent joining techniques for such plastic material whereby to provide a seal against leakage of the photo fix solution from the housing.

Figure 6:
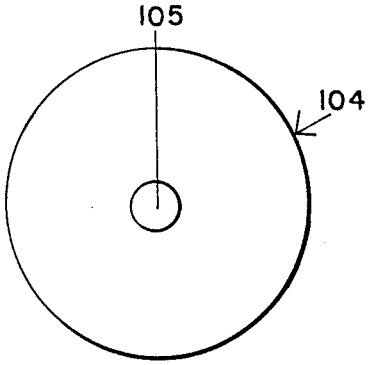
FIG. 6 is a view showing one face of a cathode plate according to the invention.

The electrode assembly, denoted in FIG. 1 generally by reference numeral 68, comprises rotatable cathode assembly 100 and anode assembly 102. As will better seen by reference to FIG. 6, cathode assembly 100 comprises a plurality of spaced-apart, vertically disposed, circular-shaped plates 104, centrally mounted for rotation on horizontally disposed, elongated shaft 106 of conductive material having an inlet end 108 and an outlet end 110, respectively, supported by end members 112, 114. The shaft ends 108, 110 are supported for rotation, according to usual techniques, in bearings 116, 118 respectively. These bearings must be carefully selected due to the very corrosive nature of the photo fix solution, and Delrin® polyacetal resin/glass bead bearings available commercially from W. S. Shamban & Company, Bearing Division, Newbury Park, Calif. will be found suitable for this purpose. As seen from the drawing, the cathode plates 104, at each end of the cathode assembly 68, are retained in position by annular shaped collars 120, 122, according to usual techniques, in which are provided set screws (not shown) for retaining the respective collars at the desired location on shaft 106. Each next adjacent cathode plate 104 is kept in predetermined spaced relationship from the preceding one by an annular-shaped insulating spacer 124 located on elongated shaft 106. Thus, silver is prevented from plating out from the spent photo fix onto shaft 106. The annular spacers 124 can be constructed entirely of some suitable insulating material or can be an annular shaped member provided with a suitable outer insulating layer. In the practice of the invention, annular spacers of 316 stainless steel, provided with a polyethylene film outer layer were used. These spacers were provided by shrinkwrapping, according to usual techniques, a suitable sized tube of polyethylene onto annular members of 316 stainless steel. Any thickness can be used provided the desired insulation characteristics are attained. Other insulating materials can obviously be used, if desired. The 316 stainless steel, because of its resistance to the corrosiveness of the solution, has also been found suitable for construction of shaft 106 (⅝" dia.×13 ⅞" long), the collars 120, 122 and for the cathode plates 104. The cathode plates 104 used in this invention are, as earlier disclosed, of circular-shape (FIG. 6) and are manufactured by stamping out 5" diameter discs from a 316 ss sheet having a thickness of approximately 1/16 inches. The circular-shaped cathode plate is provided with a centrally disposed, circular-shaped opening 105 for mounting the plate on shaft 106.

Near the outlet end 110 of shaft 106 there is provided, next adjacent collar 122, an annular-shaped spacer 123. Bearing against spacer 123, as will be seen by referring to FIG. 5, there is provided means 125 comprising an annular-shaped collar 127 and extending vertically upright therefrom an elongated member 129, the purpose for which will soon be disclosed. Elongated member 129 can be provided with a thread pattern, if desired, at both ends thereof, whereby at the one end it can be threaded into a threaded opening (not shown) in collar 127, and at the other end connected to a connector at the end of an electrical conduit (not shown) from the electrical power source. The power provided to the electrode assembly 68 must, as will be appreciated, be direct current (D.C.). Elongated member 129 must be sufficiently long enough as to extend through a suitable elongated opening not shown in top cover 66 for making the connection with the power source. As will be seen in FIG. 5, there is provided a coiled spring 131 which at one end thereof presses against the outside face of collar 127 and at the other end against annular-shaped spacer 133. The compressed spring 131 should provide such a force against collar 127 that a good electrical contact is made by collar 127 against conductive spacer 123 and collar 122, (both of 316 stainless steel) to shaft 106. Thus, current is provided to each cathode plate 104 located on shaft 106.

Figure 5:
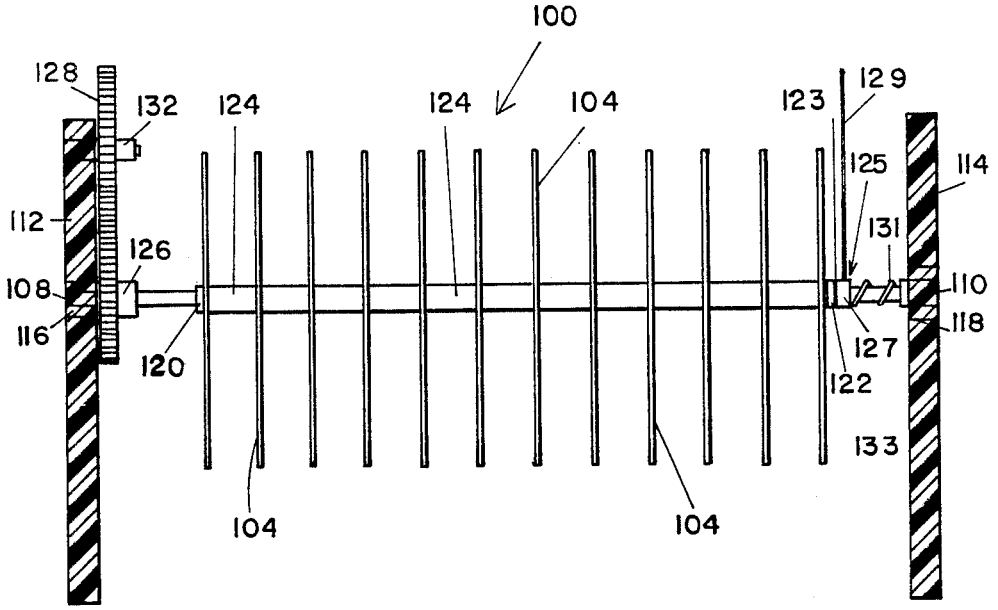
FIG. 5 is a side view of the cathode assembly in accordance with the invention.

Mounted on shaft 106, adjacent inlet end 108, as seen in the drawings, more particularly FIGS. 3, 5, is a gear 126 for driving shaft 106 and thereby rotating the cathode plates 104. Gear 126 meshes with freely rotable gear 128 which, in turn, communicates, according to conventional techniques, with a motor (not shown) and associated gear speed reducer 130 (See FIG. 1). Various motors will be found suitable for this purpose, as will be readily appreciated by those skilled in the art. In general, a ⅛ h.p. motor will be found satisfactory, to accomplish the purposes of this invention. The rotation of the cathode plates 104 on shaft 106 should desirably accomplish some mixing of the photo fix solution in the electrolytic unit; however, that rotation should not be such that the solution is agitated to any great extent. In general, it will be found that a rotational speed of about 30 rpm will be found satisfactory.

Gear 128, as will be seen in FIGS. 3, 5 is mounted on supporting end member 112 by means of a conventional elongated threaded member 132 which intrudes into horizontally disposed, threaded opening 134 provided in the end supporting member 112. The location of threaded opening 134 must be such that gear 128 properly meshes with drive gear 126 and with the driving gear (gear speed reducer) 130. Thus, as will be seen by reference to FIG. 1, the top part of gear 128 extends through a suitable elongated opening in top cover 66 and above the upper surface thereof.

Gears 126,128 used in the practice of the invention are of Delrin CL polyacetal resin, 2 inches dia., and are available commercially from Boston Gear—Incom International, Inc., Boston, Mass. It will be appreciated, however that when the size of the housing 62 is larger than that disclosed herein, gears of a larger diameter may be necessary.

Figure 8:
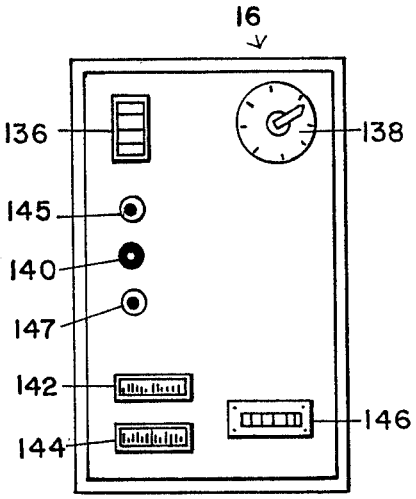
FIG. 8 shows the control panel for the electronic console shown in FIG. 1.

The motor associated with gear speed reducer 130 is located inside electronic console 16, and is commercially available from Chandler-Farquar, Boston, Mass. Nevertheless as disclosed earlier, various motors will be found satisfactory. The motor need not be contained within console 16, but this is desired. The motor can be externally located of any control means. Referring to FIG. 8, it will be seen that electronic console 16 provides an on/off power switch and light 136, a variable power knob 138 for regulating and controlling the D.C. voltage to the electrode assembly 68, a processing indicator light 140, a voltmeter 142, an ampmeter 144, and an elapsed time meter 146. Also, shown on the top panel of console 16 are fuse indicator lights 145, 147. Console 16 can be constructed according to conventional techniques using various electronic components readily available commercially; anyone skilled in the art can provide the appropriate wiring to accomplish the desired purposes and no wiring diagram is set forth herein. The console can include conventional rectifier means for converting a.c. current to d.c., when the console 16 is connected to an a.c. power source.

The anode assembly 102 (FIGS. 3, 4) comprises a plurality of vertically disposed anode plates 148, located in spaced apart location along the length of bottom portion 64 of the housing 62, and in planes parallel to one another. Each anode plate is defined by top and bottom edges 150, 152, respectively, and side edges 154, 156, which are in sealed engagement with the inside surface of side walls 74, 76, respectively. As will be readily seen by reference to FIG. 3, bottom edges 152 of the anode plates 148 are supported by and rest on respective top edges 91 of vertically disposed planar members 88. These edges are in sealing engagement, also, the reason for which will soon be made clear.

It will be seen that a plurality of separate and distinct compartments or chambers, denoted generally by reference numeral 158, are provided within bottom portion 64, defined by the combination of the vertically disposed next adjacent anode plates 148 and next adjacent vertically disposed members 88 by which the anode plates are supported. Each compartment, moreover, locates the relationship of an anode plate-cathode plate-anode plate. It will be appreciated that the spacing between the anode-cathode plates can vary somewhat. The closer the plates are located with respect to one another, in general, the greater will be the amount of silver plating out under any particular set of conditions. Thus, the more quickly the plated out silver will build up on the cathode plates and the more often that it will need to be removed. In the preferred embodiment of the invention, next adjacent anode plates are spaced approximately ¾ inches apart, face-to-face. And, the face of an anode is located approximately ⅜ inches from the next adjacent face of a cathode. The vertically disposed cathode plates 104 are each located centrally with respect to the inside surface of the upright members defining a chamber 158. In the practice of the invention, the width of the chambers 158, i.e., the distance between next adjacent facing surfaces of members 88 measured ¾ inches, the same as the distance between the next adjacent anode plates, and the chambers extend laterally the entire inside width of the bottom portion 64.

Figure 7:
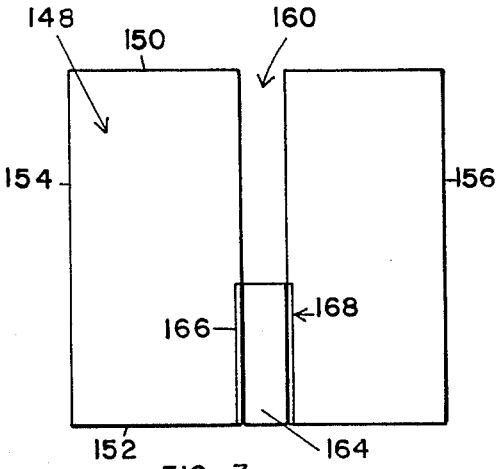
FIG. 7 is a view showing one face of an anode plate according to the invention, and showing the vertically disposed, centrally located opening therein through which the spent photo fix solution must pass in order to flow into the next chamber in the electrolytic unit.

The anode plates 148 as better seen in FIG. 7, are of a generally square configuration, the dimensions of which will depend somewhat upon the inside dimensions of bottom portion 64, the diameter of the cathode plates 104, and the vertical distance upwards that members 88 extend. Nevertheless, as will be appreciated by those skilled in the art, in general, the anode plates 148 should not be appreciably larger than the diameter of the cathode plates. Each anode plate is further defined by a vertically disposed, elongated, rectangular-shaped opening 160 located intermediate the side edges 154, 156 which provides the only means by which spent photo fix solution can flow from the inlet end of the housing or receptacle 62 of the electrolytic unit 14 toward and out the outlet end thereof. Thus, as will be readily appreciated, the flow of incoming spent photo fix solution will be around and across the front face of the cathode plate 104 first located in the cathode assembly, adjacent end supporting member 112, across the back face thereof, and through the elongated opening 160 in the first appearing anode plate 104 into the first located electrolytic chamber 158. The flow of photo fix solution then continues in similar manner toward the discharge end of the housing 62 where it finally overflows out discharge opening 84 and via conduit 162 by gravity into compartment 32 of holding tank 12 through opening 163 to which is connected pipe 165 extending downwardly into that compartment. The level of lower concentration spent solution in compartment 32 will ordinarily be somewhat higher than that of the spent solution in compartment 30, as shown by the drawing. If desired, the divider 34 need not extend to the top of the holding tank bottom portion, to allow for overflow from compartment 32 back into compartment 30. This will allow, for example, for possible malfunction of metering pump 42, in the event spent solution was not being pumped out of compartment 32, as fast as solution was going into it.

The anode plates 148 used in the practice of this invention were constructed of two rectangular shaped plates (2 3/16"×5×) of graphite having a thickness of ⅛" joined together at the bottom by an insulating spacer 164 (1"×2¾"). The inner edges of the graphite plates fit tongue and groove fashion in sealed engagement, in vertically disposed channels 166, 168 provided in spacer 164. This spacer 164 can be of any material provided it is an insulator and can withstand the corrosiveness of the photo fix solution. The spacer used in the practice of the invention was constructed from commercially available polyacylate on each face of which was laminated a Lexan polycarbamate layer of slightly greater length, to provide the groove. Nevertheless, the preferred anode plate 148 will be of one piece with opening 160 of suitable size provided therein during manufacture of the graphite plates or cut therein subsequent to manufacture. The main thing is that flow of the spent solution be restricted as disclosed whereby the spent solution must flow against the face of a rotating cathode and around its backside before it can then pass into the next chamber 158. And, all flow is directed through the elongated opening 160 in the next anode plate 148 which is located in the direction of flow, is hereinafter more fully disclosed.

Figure 4:
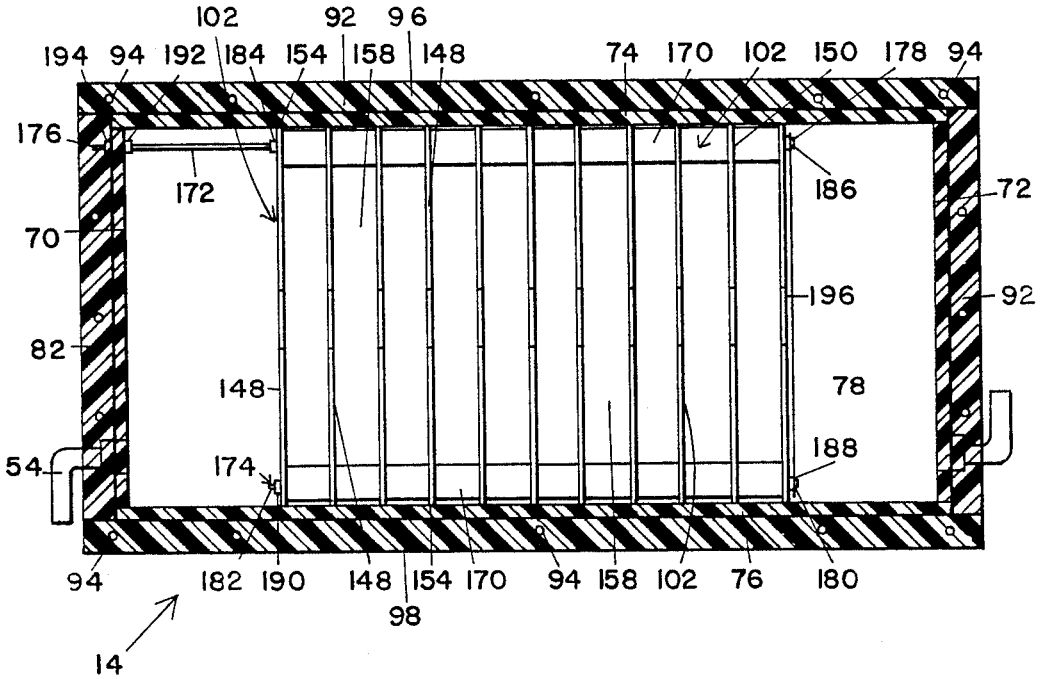
FIG. 4 is a top view of the electrolytic recovery unit shown in FIG. 3 showing the anode plates in fixed location with the cathode assembly completely removed from the electrode assembly and with the housing intact.

Next adjacent anode plates 148 are located in the desired spaced relationship from one other and from adjacent cathode plates 104 by annular-shaped spacers 170 which, like the anode plates 148 are of graphite. The anode plates 148 and spacers 170 are held in assembly by means of elongated members 172,174, the ends of which 176,178,180,182, respectively, are provided with a thread pattern (not shown). Elongated member 172, as disclosed in FIG. 4, is somewhat longer than member 174 and extends through an opening in end wall 70 outside the housing a sufficient distance whereby to connect the electrical conduit (not shown) from the d.c. power source, located within console 16 thereby providing current to the electrolytic recovery unit electrodes. Suitable threaded fasteners 184,186,188,190,192,194 are provided on elongated members 172,174 to keep the anode plates in assembly and to position the elongated members 172,174 relative to the plates assembled. At the discharge end of the housing, a connecting member 196 of suitable conductive material is provided connecting together elongated members 172,174. Thus, when the appropriate electrical connection is made at end 176 electrical current will be conducted by the anode assembly from anode plate to anode plate via elongated member 172, connecting member 196, and elongated member 174. The most preferred material for the elongated members 172,174, the threaded fasteners, and the connecting member 196 is titanium, as such has been discovered to be highly resistant to the corrosiveness of the spent photo fix solution. Nevertheless, graphite rods will be found suitable as will graphite-coated stainless steel rods. Although good conductors, rods of stainless steel are found not suitable at all, as such rods readily decompose during operation of the electrolytic recovery unit.

As will be seen by reference to FIG. 1, metering pump 42 is connected by conduit 198 to compartment 32 via conduit 200 which extends vertically downwardly below the surface of the reduced silver concentration photo fix solution 202 contained therein. Thus, that reduced concentration solution is sucked up by metering pump 42 and metered to vertically disposed column 18 via conduit 204 wherein further silver is recovered from the spent photo fix solution that cannot be recovered during the first stage processing, i.e., electrolytic recovery. Conduit 204 is connected to the inlet opening 208 provided in the top closure 210 of column 18. This opening communicates with elongated tubular member 212 which extends vertically downwardly in column 18 through treating material 214, terminating adjacent the bottom closure 216 of the treatment column 18, which seals the column on the bottom whereby any material introduced into column 18 can only exit therefrom by flowing upwardly through treating material 214 and out the outlet opening 218, being then discharged to waste or further recycling via conduit 220.

In the operation of the treatment plant 10, according to the invention, spent photo fix solution is collected in holding tank 12, after which the concentration of silver in that particular batch is determined, according to usual techniques. This can be determined by a conventional Atomic Absorption Spectrophotometer available commercially from Perkin-Elmer. Then, based upon the silver concentration determined and the desired flow rate, the variable power knob 138 on console 16 is set to deliver the desired D.C. voltage, and the Variac (not shown) is adjusted to provide the desired current flow between the anode and cathode. In general, with silver concentrations in the spent photo fix solution of from about 1200 to about 6,000 ppm, the voltage should be controlled at about 1.0 to about 1.5 volts D.C., and the current controlled at from about 5 to 12 amps. The lower the silver concentrations, in general, the lower should be the volts/amperes provided. Thus, in the case of a relatively weak silver concentration in the spent hypo, i.e., 0.1 oz. silver/gal. soln., at a flow rate of about 0.5 gal./hr., good results will be obtained at 1.0 volt, 2 amps. Where a rich solution (1 oz. silver/gal. soln.) is processed, the power requirements should be set at about 1.5 volts, 10 amps. In general, however, in the practice of the pactice of the invention, power requirements of 1.5 v., 8 amps. have been found satisfactory for processing most solutions that fall about mid-point within the above concentrations, at a flow rate of about 0.5 gal/hr. Nevertheless, it will be appreciated by those skilled in the art that the power requirements are determined in part by the flow rate and at other flow rates the volts/amps requirements will need be somewhat adjusted for optimum conditions depending on the silver concentration in the spent solution. Once the concentration of silver in the spent photo fix solution in holding tank 12 is determined, and the volt/ampere values are set, these values need not be changed during that processing cycle so long as the flow rate is maintained the same. The solution being metered from the holding tank during the cycle will all be of the same silver concentration, when the system is being batch operated. Thus, all of that solution metered during the cycle will plate at the same current; hence, at the same rate. When the level of spent solution in holding tank 12 reaches liquid level switch 60, the metering pump is activated. Thus, spent solution is metered to the electrolytic recovery unit 14 which, on activation of metering pump 42, is also powered on. The electrolytic recovery operation continues until the level of spent solution in holding tank 12 is reduced to the level sensed by liquid level switch 58. At that point, the metering pump is de-activated and the electrolytic recovery unit powered off. When this occurs, i.e., the electrolytic recovery unit is inactivated, it is desired that it be disconnected completely from the power source. Otherwise, the solution remaining in the unit tends to deteriorate. This disconnection can be accomplished by physically disconnecting the power source from the unit. Preferably, however, a suitale relay will be provided in the wiring in console 16 whereby, on powering off the electrolytic unit it will disconnect the unit from the power source. The relay should, of course, operate to connect the unit with the power source when the liquid level switch 60 triggers the treatment plant to the operative mode.

Since the voltage across the plating system is substantially constant in any given batch processing and the silver concentration in the holding tank is substantially constant, it can be expected that operation for an approximate known time will sufficiently plate the cathode plates to require stripping. Thus, the elapsed time meter 146, as shown on console 16 can be used to indicate when stripping of the cathode plates is most appropriate. Moreover, such can be determined by observation as the plating operation is clearly visible through housing 62.

The amount of silver plated out on the cathode plates 104 will diminish from plating chamber to plating chamber, as the spent fix solution flows through the electrolytic recovery unit 14 from the inlet end to the overflow end of housing 62. The greatest amount of silver will be plated out in the first electrolytic chamber 158, as the cathode plate 104 located nearest the inlet end acts more as an impedance to flow in the lengthwise direction of the bottom portion 64 than as a cathode plate. Thus, in order to flow into the first chamber 158, the solution is caused to flow around the first located cathode plate and across its front and back surfaces in order to flow through opening 160 provided in the first located anode plate. Similarly, with each successive cathode plate 104 silver not only plates out from solution onto the plate, each cathode plate functions also to determine the flow pattern of the fix solution within and through housing 62 and into the next plating chamber as it flows through the electrode assembly 68. And it will be appreciated in referring to FIG. 3 that in each electrolytic chamber 158 a cathode is located intermediate two anode plates, providing for recovery of silver on both surfaces of the cathode. As the plating operation progresses in any particular operation of the treatment plant, the plated silver occasionally "sheds" from the rotating cathode plates. Thus, it then falls to the bottom of the respective chamber 158 for later recovery, in addition to recovering that silver plated out onto the cathode plates. It is of critical importance that vertical members 88 be of such a height that neither the anode plates nor the cathode plates come into contact with the build-up of particles of silver that have shed from the rotating cathode plates and fallen to the bottom of the respective chambers. Otherwise, those particles will likely redissolve in the solution, thus reducing the efficiency of the electrolytic recovery.

Quite advantageously, the electrolytic recovery unit 14, according to the invention, provides incremental treatment of the spent photo fix solution being treated. Thus, the anode-cathode-anode combination in any particular chamber operates on only a portion of the solution in the unit. And, during such an operation a portion of the silver concentration available is recovered. That increment of solution having a somewhat lesser concentration of silver is then operated on in the next chamber 158 by the next combination of anode-cathode-anode plates, and the silver concentration in that increment is further reduced, and so on, until that increment finally is discharged to the holding tank compartment 32. This incremental treatment of the spent solution has been found to provide greater efficiencies in the amount of silver recovered from a particular solution than when such a solution is treated by an electrolytic unit without separate treatment chambers. Moreover, silver has been found to plate out rather uniformly over the entire surface of the cathode plate in any particular chamber. Of further advantage, there is no buildup of silver only at the outer edge of the circular-shaped cathode plates whereby to present operating problems experienced with such a shaped cathode plate heretofore. The greater efficiency in silver recovery is believed due, at least in part, to the somewhat circuitous path that the spent solution takes in flowing through the electrolytic recovery unit. Thus, with the arrangement of the electrodes in the invention, it seems more likely that any particular silver ion will be more likely to be plated out than where such a flow path does not exist. The spent solution containing the silver ions must necessarily pass closely adjacent to the cathode plates provided, and not just one but all the cathode plates in the assembly, before the solution increment containing it is finally discharged from the electrolytic unit. Moreover, lookin at it in another way, the invention causes each increment of the spent solution being treated to be subjected to the same dwell time within the unit, which at the flow rate disclosed above amounts to 2½ hours. No increment of spent solution is allowed to flow through the recovery unit without being subjected to electrolytic treatment.

Various amounts of silver will be recovered during the electrolytic processing depending somewhat upon the concentration of the silver in the spent solution being processed. Nevertheless, it has been found that sufficient silver can be recovered by electrolytic recovery according to the invention from spent photo fix solutions having a concentration of as much as 6000 ppm silver, to reduce the silver content therein to 50 ppm or less.

The silver is recovered from electrolytic recovery unit 14 by first removing top cover 66 from housing 62. Then, cathode assembly 100 can readily be removed from the housing by taking hold of end walls 70,72 and raising the cathode assembly vertically upwardly (See FIG. 3). Thus, the cathode assembly is readily separated from the anode assembly. The cathode plates 104 can then be individually flexed slightly causing the plated silver to flake-off therefrom. The silver that flaked-off during processing can, and which fell to the bottom of chamber 158 then be recovered by emptying any solution from the housing and collecting the silver particles in a filter or suitable sized strainer.

In a somewhat modified version of the electrolytic recovery unit 14, not shown in the drawings, the inside surfaces of side walls 74, 76 will be provided with spaced-apart, vertically disposed grooves, into which the end edges of the anode plates and members 88 will intrude. Thus, it will be possible to remove the anode plates 148 from housing 62 by raising the plates vertically upwardly and, in turn, the respective members 88. Accordingly, any silver shed from the cathode plates during operation can readily be recovered. With such an arrangement, moreover, the grooves will determine the desired spacing between the anode plates, making unnecessary the spacers 170. Rather than providing elongated rods 172, 174, and connecting member 196 for conducting electricity from anode plate to anode plate, a conductive strip can be attached outside housing 62, adjacent its top edge. That strip can function as a conductive manifold with appropriate connections extending therefrom making contact with a side edge of each anode plate, through sealed openings in the side wall of the housing. These openings should be located above the liquid level in the housing so that leakage therethrough is avoided.

The reduced silver concentration solution is then further subjected to a silver recovery operation in a second stage of the processing of the spent hypo solution by passing it through column 18 containing material capable of recovering silver from relatively low concentration solutions. This column can contain either shredded steel wool as the treating material or a suitable ion exchange resin. In the practice of the invention, column 204 (36″×12=dia.) was filled with 21 lbs. Grade No. 3 shredded steel wool, available commercially from Rhodes American Corporation, Chicago, Ill. This shredded steel wool comprises particles measuring about ⅛″ to about ½ in length. It resembles a chopped-up Brillo pad. Nevertheless, other sizes of steel wool will be found satisfactory in the practice of the invention provided such does not erode too quickly, and is capable of reducing the silver concentration to the extent desired. With a flow to treatment column 18 between from about 18 cc/min. to about 38 cc/min. the silver plates out on the shredded steel wool in sufficient amount to readily reduce the silver concentration in the solution to less than about 5 ppm provided the solution introduced has a concentration of no more than about 60 ppm. Thus, the spent photo fix solution from a photographic processing operation is then suitable for disposal to waste according to the EPA standards set.

A suitable column for use in the practice of the invention can be obtained from Parke International, Inc., Longbeach, Calif., under the trade designation 1236-45-45. This is a glass fiber wound plastic column 12″×36″ having top and bottom openings of 4.5″. Such a column meets the two major requirements of a column useful in the practice of the invention: (1) high bursting strength, and (2) elongated. A relatively long column is required to provide the necessary surface area for absorption of the silver from the solution onto the shredded steel wool.

As the solution passes through the column of shredded steel wool, the steel wool particles are eroded by the solution, due to the solution's relatively high acidity. Thus, the column of treatment material decreases in size, i.e., becomes compacted, and channeling of flow occurs. When this happens, the column no longer is useful in recovering silver to the extent desired, and this is a critical feature of the invention, the spent shredded steel wool must then be replaced with new. In general, it has been found that the life of a column of shredded steel wool used in the practice of the invention is about 600 hours and silver must be recovered from the electrolytic recovery unit about every 300 hours of operation. Thus, the operator can readily determine when such actions need be taken by observation of the elapsed time meter 146 on console 16.

It will be readily appreciated by those skilled in the act of metal recovery that, although this invention has been particularly described with respect to the recovery of silver from photographic and x-ray fix solutions, it is readily adapted to the recovery of, particularly, other precious, metals from solution as well. Thus, for example, the invention can be used for treatment of, and the electrolytic recovery of gold from waste solutions thereof. And, the invention may be found useful also in treatment of waste electroplating solutions.

Other modifications and changes, as will be understood, can be made in the invention and its form and construction without departing from the spirit and scope thereof. The embodiments disclosed herein are merely exemplary of the various modifications that the invention can take and the preferred practice thereof. It is not, however, desired to confine the invention to the exact construction and features shown and described herein, but it is desired to include all such as properly come within the spirit and scope of the invention disclosed.

What is claimed is:

1. A treatment plant for the recovery of a precious metal from liquid hazardous waste material in which the precious metal is dissolved comprising, in combination:

a. a holding tank for the liquid precious metal waste material;

b. an electrolytic recovery unit for receipt of the said hazardous waste material from the holding tank therefor and for recovering a major portion of the precious metal from the hazardous waste material by plating out the precious metal, said electrolytic recovery unit comprising in combination a housing defined by a sealed, box-like bottom portion having an open top and defining a cavity for containment of an electrode assembly, and a detachable top cover for said bottom portion, said electrode assembly being horizontally disposed in said cavity and comprising a plurality of vertically disposed, alternating, anode plates and cathode plates;

c. an elongated, vertically disposed column containing material capable of recovering a further amount of the precious metal from the said waste material and for receiving said waste material containing a reduced level of the precious metal from the electrolytic recovery unit.

2. A treatment plant according to claim 1 wherein the said holding tank comprises a bottom portion defining at least one compartment for the holding of said liquid waste material and a top closure.

3. A treatment plant according to claim 2 wherein the said bottom portion of the holding tank is sealed, having no openings therein whereby the waste material contained therein can leak from the said tank into the surrounding environment.

4. A treatment plant according to claim 3 wherein the said holding tank comprises a vertically disposed dividing wall located therein whereby to define the side-by-side compartments, one compartment being suitable for holding waste material having a relatively high precious metal content and which is to be metered to the electrolytic recovery unit for the electrolytic recovery from the waste material of a major portion of the precious metal contained therein, and the other compartment being suitable for holding waste material having a relatively low precious metal content due to the fact that such has already been subjected to electrolytic treatment.

5. A treatment plant according to claim 1 wherein the said elongated, vertically disposed column comprises an elongated bed of shredded steel wool.

6. A treatment plant according to claim 5 wherein the said elongated column is of such length and diameter as to hold a predetermined amount of shredded steel wool whereby to provide the necessary surface area for absorption of the precious metal from the reduced concentration waste stream so that the concentration of the precious metal in that wast stream can be further reduced to the extent desired.

7. A treatment plant according to claim 6 wherein the said elongated column is characterized by a diameter of 12" and a length of 36".

8. A treatment plant according to claim 7 wherein the bed of shredded steel wool comprises particles measuring from about ⅛" to about ½" in length.

9. A treatment plant according to claim 8 wherein the bed of shredded steel wool particle weighs 21 lbs.

10. A treatment plant according to claim 1 wherein the electrode assembly further comprises an elongated shaft of predetermined length, means located within said housing for and supporting the ends of said shaft for rotation in the sealed housing, a centrally disposed opening being provided in each of said plurality of cathode plates through which said elongated shaft passes and said cathode plates being supported by said shaft for rotation.

11. Electrolytic rcover unit suitable for use in the recovery of silver from a spent photo fix solution comprising in combination:

a. a sealed housing comprising first and second vertically disposed, planar, spaced-apart end walls and first and second vertically disposed, planar, spaced-apart side walls, each of said walls having top and bottom edges and the side and end walls being in opposition to and parallel to one another, said end walls and said side walls intersecting one another at right angles whereby to form a rectangular box-like cavity, a bottom closure supporting the bottom edges of said end and side walls, and being in sealing, integral engagement therewith, and a top closure removably attached to the end and side walls at their top edges and in sealing engagment therewith, an opening in said first end wall located adjacent the top edge thereof for introduction of spent photo fix solution, an opening in said second end wall located adjacent the top edge thereof for discharge from the said box-like cavity of photo fix solution from which the silver concentration has been reduced, and first and second elongated openings in said removably attached top closure located adjacent respective said end walls; and (b). an electrode assembly comprising a plurality of alternating, vertically disposed, anode plates and cathode plates within the said box-like cavity located in a direction lateral to the side walls thereof.

12. Electrolytic recovery unit according to claim 11 wherein a plurality of vertically disposed, elongated, planar members are provided in said housing in spaced-apart relationship intermediate the said end walls and parallel thereto, said members each being defined by a bottom edge, and a top edge and the bottom edges of said members being supported by the said bottom closure and integral therewith, and the top edges of the said members all terminating in the same horizontal plan at a predetermined distance above the bottom closure whereby a plurality of elongated individual chambers are provided in the housing located one after the other between the said end walls.

13. Electrolytic recovery unit according to claim 11 wherein the electrode assembly comprises a cathode assembly defined by the cathode plates and an anode assembly defined by the anode plates and such assemblies are capable of being separated one from the other.

14. Electrolytic recovery unit according to claim 13 wherein the cathode assembly comprises a plurality of spaced-apart, circular-shaped rotatable cathode plates, an elongated shaft of predetermined length for supporting said cathode plates in spaced-apart relationship to one another and having an inlet end and an outlet end, and vertically disposed end members for supporting the said inlet and outlet ends of the said shaft for rotation.

15. Electrolytic recovery unit according to claim 13 wherein the anode assembly comprises a plurality of vertically disposed, spaced-apart, anode plates in fixed, parallel relationship to one another and to said end walls of the housing each said plate being defined by top and bottom edges and first and second side edges, the said bottom edges of the anode plates being supported by and in sealing contact with the top edges of said vertically disposed planar members and the said first and second side edges terminating at and being in sealing engagement with the side walls of the housing.

16. Electrolytic recovery unit according to claim 15 wherein an elongated, rectangular-shaped opening is provided in each said cathode plate intermediate the said side edges and extending a predetermined distance downwardly from the said top edge.

17. Electrolytic recovery unit according to claim 16 wherein said housing comprises a clear plastic, non-conductive material having high resistance to the corrosive nature of the waste material being processed and whereby the progress of the plating operation can be visually observed.

18. Electrolytic recovery unit according to claim 17 wherein the said clear plastic material is an acrylic plastic.

19. Electrolytic recovery unit according to claim 16 wherein an annular shaped spacer is located between each next adjacent pair of anode plates, at each outer edge thereof, whereby each said pair of anode plates is located in said anode assembly in predetermined spaced apart parallel location.

20. Electrolytic recovery unit according to claim 19 wherein the said anode assembly further comprises a pair of elongated members of electrically conductive material, each being of predetermined length and one being longer than the other, the longer of said elongated members extending through the said annular shaped spacers located at one outer edge of the anode plates and having one end thereof extending through an opening in said housing and terminating outside said housing whereby to provide a connection for an electrical power source and the other end terminating in the housing just beyond the last anode plate in the anode assembly, the other of said elongate, electrically conductive members extending through the annular shaped spacers located at the other outer edge of the anodes plates, the ends of such other elongated member each terminating just beyond the first and last anode plates in the anode assembly, fastening means being located in operative association with said elongated members and with the first and last anode plates whereby the anode plates and annular shaped spacers are provided in unitary assembly with one another and a member of suitable length and of electrically conductive material connecting the ends of the said elongated members together where such project beyond the last anode plate in the anode assembly whereby electrical current will be conducted by the anode assembly from anode plate to anode plate.

21. Electrolytic recovery unit according to claim 20 wherein the said elongated electrically conductive members, fastening means and conductive connecting member are all of titanium metal.

22. Electrolytic recovery unit according to claim 21 wherein an annular shaped spacer characterized by its insulating properties is located between each next adjacent cathode plate and said elongated shaft rotatably supporting said cathode plates extending through each said insulating spacer.

23. Electrolytic recovery unit according to claim 22 wherein means for rotation of said elongated shaft is provided in operative association with one of the said vertically disposed end members for supporting the one end of the said shaft, and means are provided at the other end of the said shaft for providing electric current to the said shaft and in turn to each cathode plate in the cathode assembly located on the shaft.

24. Electrolytic recovery unit according to claim 23 wherein said elongated shaft and cathode plates are of #316 stainless steel.

25. Process for the electrolytic recovery of silver from spent photo fix solutions in which the silver is dissolved comprising:

(a). providing spent photo fix solution to an electrolytic recovery operation at a predetermined fixed flow rate;

(b). subjecting a first predetermined increment of that spent solution to successive electrolytic recovery operations and then (c). subjecting successive predetermined increments of the spent solution to the same successive electrolytic recovery operations.

26. Process according to claim 25 wherein the flow rate of the spent solution to the electrolytic recovery unit is about 0.5.

27. Process according to claim 26 wherein the dwell time for each said increment of spent solution within the electrolytic recovery unit is about 2.5 hours.

28. Process according to claim 25 wherein the silver concentration in the spent photo fix solution comprises from about 1200 to 6000 ppm and the successive incremental electrolytic operations reduce the silver concentration to less than 50 ppm.

29. Process for treating a hazardous waste material comprising a precious metal in solution in said waste material comprising the following steps:

a. collecting the said hazardous waste material containing the precious metal in solution in a holding tank;

b. metering the said hazardous waste material from the holding tank to an electrolytic recovery unit;

c. subjecting an incremental portion of the hazardous waste material as it flows through the electrolytic unit to electrolytic action in stepwise fashion whereby the concentration of the precious metal in the said incremental portion is reduced in stages; and d. subjecting succeeding incremental portions of said waste material to like electrolytic action whereby the concentration of the precious metal in the waste material is reduced to the desired level.

30. Process for treating hazardous waste material according to claim 29 wherein the hazardous waste material is a photo fix solution containing silver.

31. Process for treating hazardous waste material according to claim 30 wherein the concentration of the silver in the waste material is determined prior to such material being metered to the electrolytic unit and the voltage to the electrolytic unit is controlled in accordance with the predetermined silver concentration in the waste material.

32. Process for treating hazardous waste material according to claim 31 wherein the silver content in the waste material is fro about 1200 ppm to about 6,000 ppm, and the voltage is controlled in the range from about 1.0 volt D.C. to about 1.5 volt D.C.

33. Process for treating hazardous waste material according to claim 32 wherein the current to the electrolytic unit is maintained at from about 5 to 12 amps as the silver is plated out of solution.

34. Process for treating hazardous waste material according to claim 33 wherein the flow rate of the waste material being metered to the electrolytic unit is maintained substantially constant, the silver concentration in the wast material is substantially constant and the voltage/amperage to the electrolytic unit is substantially constant whereby silver plates out of the waste solution uniformly on such cathode plate.

35. Process for treating hazardous waste material according to claim 29 wherein each said incremental portion of the waste material as it passes through the electrolytic unit is caused to flow around each succeeding rotating anode plate and across the front and back surfaces thereof whereby to deposit silver uniformly on each anode plate and on the front and back surfaces thereof.

* * * * *